United States Patent [19]

Baker

[11] 4,418,627

[45] Dec. 6, 1983

[54] SHELF-TYPE STORAGE SYSTEM

[76] Inventor: Edward A. Baker, 35992 Woodridge Cir., Apt. 107, Farmington Hills, Mich. 48018

[21] Appl. No.: 226,634

[22] Filed: Jan. 21, 1981

[51] Int. Cl.[3] ..... A47B 7/00

[52] U.S. Cl. ..... 108/91; 108/111; 108/153; 312/108; 312/111

[58] Field of Search ..... 312/107, 108, 111, 259, 312/257 SK, 4, 5, 6, 214; 108/153, 91, 111; 52/729; 206/511

[56] References Cited

U.S. PATENT DOCUMENTS

| | | | |
|---|---|---|---|
| 420,201 | 1/1890 | Hodges | 52/729 |
| 687,740 | 12/1901 | French | 312/108 |
| 1,390,374 | 9/1921 | Niles | 312/107 |
| 1,648,277 | 11/1927 | Korb | 312/107 |
| 2,083,114 | 6/1937 | Blechman | 312/108 |
| 2,181,918 | 12/1939 | Scheinman et al. | 312/108 |
| 2,539,710 | 1/1951 | Sziklay | 312/259 X |
| 3,053,558 | 9/1962 | Challas, Jr. et al. | 312/111 |
| 3,361,293 | 1/1968 | Box | 206/511 |
| 3,512,857 | 5/1970 | Butera | 312/107 |
| 4,056,295 | 11/1977 | Downing | 312/107 |
| 4,265,501 | 5/1981 | Halliburton | 108/91 X |
| 4,318,230 | 3/1982 | Bacon | 108/91 X |
| 4,345,802 | 8/1982 | Sorensen | 108/91 X |

*Primary Examiner*—James T. McCall

*Attorney, Agent, or Firm*—Harness, Dickey & Pierce

[57] ABSTRACT

A storage system comprising a plurality of shelf units adapted to be stacked vertically upon one another. Each of the shelf units includes a relatively rigid, horizontally disposed shelf member and a liner member fabricated of an inexpensive, yet relatively strong and durable material, such as corrugated paperboard, cardboard or the like. The vertically stacked shelf units are adapted to be mounted upon either a fixed or a rolling base, and in the case of a rolling base, said base may be operatively associated with a track system whereby vertically stacked assemblies of the storage shelf units may be moved along the track system to provide a highly compact storage system incorporating only a single aisleway for multiple storage units.

24 Claims, 7 Drawing Figures

FIG. 1.
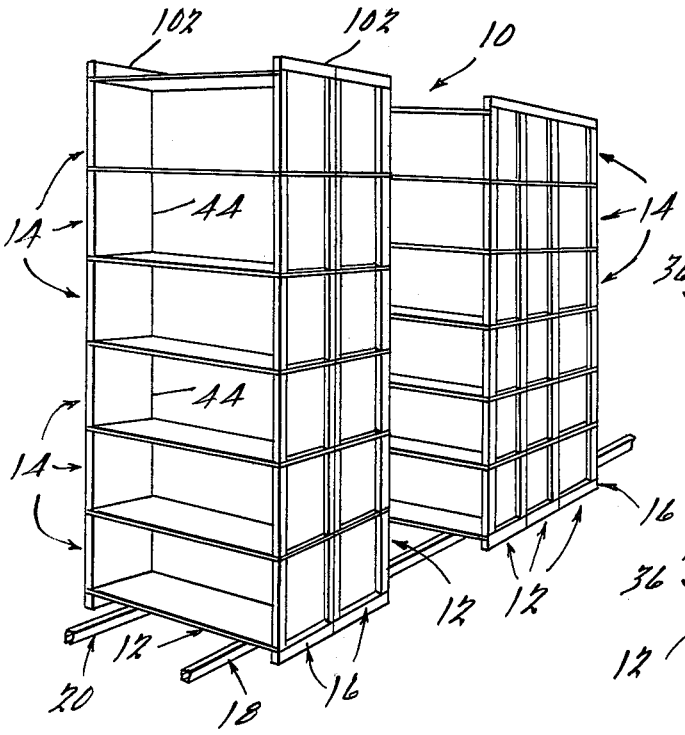
FIG. 2.
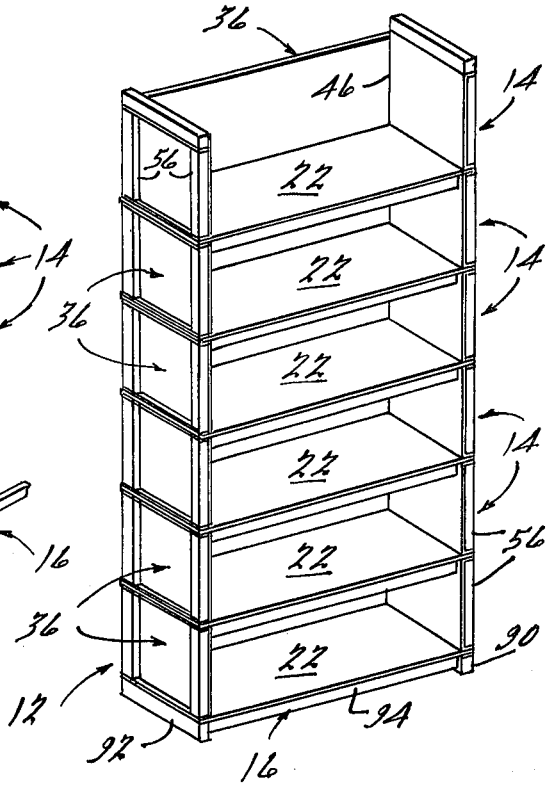
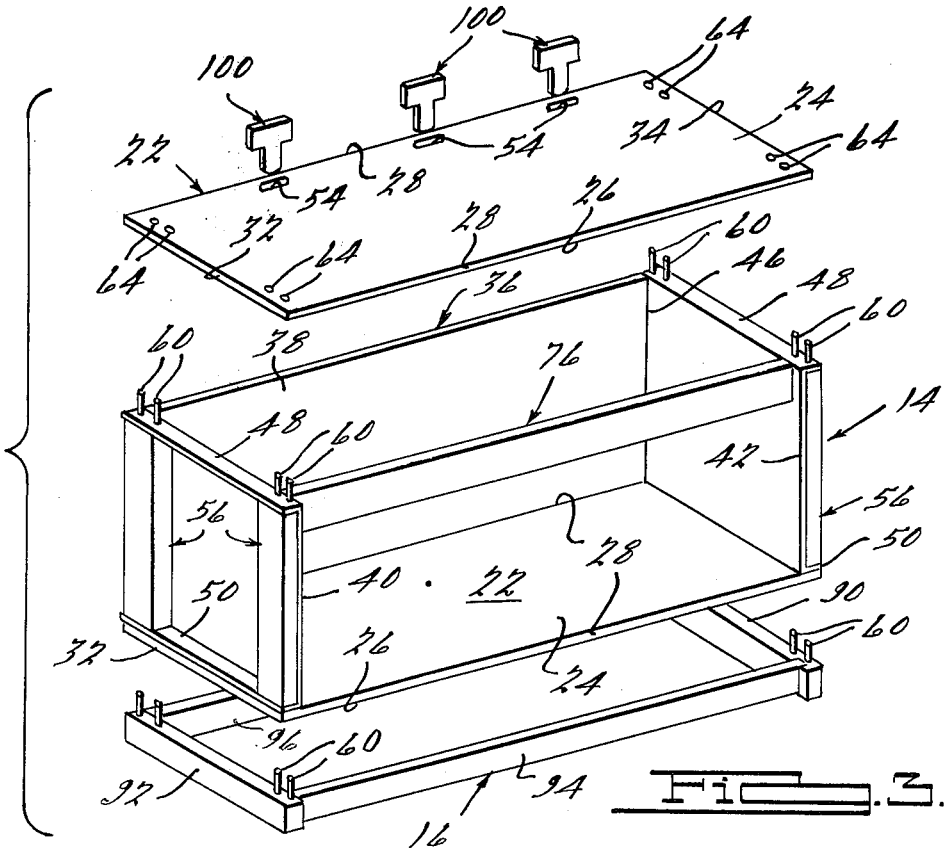
FIG. 3.

SHELF-TYPE STORAGE SYSTEM

BACKGROUND AND SUMMARY OF THE INVENTION

Various types of storage systems, both high and low density have heretofore been known and used in the prior art wherein a plurality of shelf assemblies consisting of vertically stacked shelf units are used either independently or in combination so as to maximize storage for a given storage area. In high density storage applications, the storage arrangement typically includes rows of storage assemblies, each of which provides a multiplicity of vertically stacked storage shelves, which are supported upon suitable base structures and which may be either fixed or movable to provide for access to the storage shelves. Exemplary of the movable storage arrangements is the storage structure shown in U.S. Pat. No. 3,967,868 and in the patents cited and referred to therein. Fixed storage shelving arrangements consisting of a plurality of vertically stacked shelves are depicted in U.S. Pat. Nos. 4,056,295; 3,704,792; 3,217,671; 3,053,558; 3,316,862; 3,695,190; 3,549,020; 3,368,856; 3,861,327; 4,182,244; 4,181,352; and 3,234,896.

The present invention is intended to provide a novel storage system consisting of one or more assemblies each comprising a plurality of vertically stacked shelving units which are constructed or fabricated of inexpensive component parts and whose manufacture can be carried on in a practical manner and at low cost. In accordance with the present invention, the shelf units are fabricated of low cost materials such as pressed or molded composition or particle board, preferably consisting of compressed wood chips or the like, along with corrugated cardboard or paperboard structural members which cooperate in a manner so as to provide an extremely rigid, strong, durable, yet economical structure. The individual shelf units are designed so that they may be conveniently assembled and disassembled for shipment, storage, and use, and may find application in multiple storage units such as in movable track-type storage units wherein the assemblies of vertically stacked shelf units are arranged for sliding movement either individually or in back-to-back relation on an associated track system. Alternatively, the shelf assemblies may be used individually or in combination with one another in a fixed installation, as will hereinafter be described in detail.

It is accordingly a general object of the present invention to provide a new and improved storage system.

It is a more particular object of the present invention to provide a new and improved storage system which may be used in high or low density storage applications.

It is yet another object of the present invention to provide a new and improved storage system consisting of a plurality of vertically stacked storage units, each of which units may be fabricated of low cost materials, including materials such as corrugated cardboard or paperboard and composition or particle board.

It is another object of the present invention to provide a new and improved storage system, as above described, which is inexpensive to construct, is easy to assemble, and will have low shipping and packaging costs.

It is a further object of the present invention to provide a new and improved shelf unit construction which will be resistant to damage in shipment and handling and which includes a corrugated liner member that is formed into a generally U-shaped shell which provides substantial rigidity and structural integrity to the shelf unit and the overall assemblage of a plurality of such units stacked vertically upon one another.

It is a further object of the present invention to provide a new and improved shelf-type storage structure, as above described, which comprises a plurality of post members which are disposed at the four corners of the shelf units and are interconnected by alignment means that prevent rotation of the respective post members, and together with the associated liner members, allows for the transfer of columnar loading in essentially the same manner as would be accomplished by a single longitudinal post running the entire length of the storage assembly.

It is a related object of the present invention to provide a shelf structure of the above-described type wherein the alignment pins provide for ease of assembly and assure structural rigidity and integrity of the units.

It is still a further object of the present invention to provide a new and improved storage system that will find universality of application and by virtue of having a large number of common components, will minimize inventory and replacement costs to the extreme.

It is yet another object of the present invention to provide a shelving structure which may include various numbers of incremental shelving units which may be combined to produce a variety of storage devices of different storage capacity and which may find application in fixed installations or in movable track systems or the like.

Other objects and advantages of the present invention will become apparent from the following detailed description taken in conjunction with the accompanying drawings.

BRIEF DESCRIPTION OF THE DRAWINGS

FIG. 1 is an elevated perspective view of a typical installation of a storage system incorporating the principles of the present invention;

FIG. 2 is an elevated perspective view of one of the assemblies of shelf units incorporating the principles of the present invention;

FIG. 3 is an exploded assembly view of one of the shelf units embodying the principles of the present invention;

DESCRIPTION OF THE PREFERRED EMBODIMENTS

Figure 4:
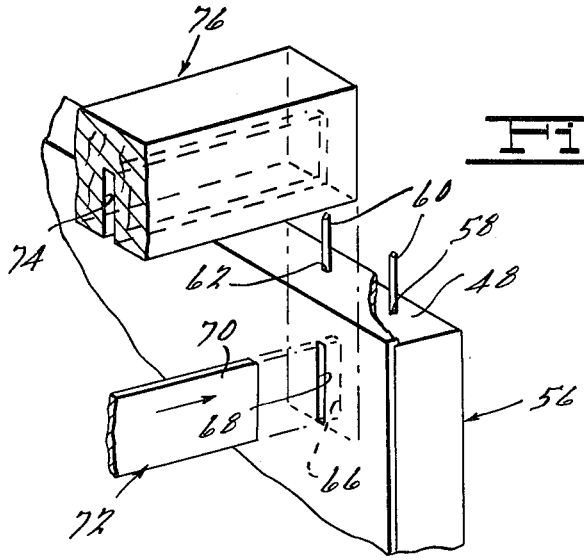
FIG. 4 is an enlarged fragmentary exploded perspective view of the interconnection between the ends of the support members of each of the shelf units and the associated support posts and liner member.

Referring now in detail to the drawings and in particular to FIG. 1 thereof, a shelf-type storage system 10, in accordance with one preferred embodiment of the present invention, is shown as comprising a plurality of storage shelf assemblies 12, each of which comprises a plurality of vertically stacked shelf units, generally designated by the numeral 14. Each of the vertically stacked plurality of shelf units 14 constituting the shelf assemblies 12 is preferably mounted upon a suitable base structure 16 which may be either fixed or movable, depending upon the particular application thereof. By way of example, in FIG. 1, the plurality of shelf assemblies 12 are adapted to be movable along a ganerally linear path upon a pair of spaced parallel tracks or the like 18 and 20, and as will be appreciated by those skilled in the art, the base structure 16 of each of the assemblies 12 is provided with suitable roller means (not shown) which cooperate with the tracks 18, 20 so as to permit rolling movement of the assemblies therealong. Of course, in applications wherein the shelf assemblies are adapted to be fixedly, i.e., non-movably, mounted, the aforesaid tracks 18, 20 and roller means would not be necessary. The tracks 18, 20 may be of any desired length, although one particular useful installation of the plurality of shelf assemblies 12 incorporates tracks 18, 20 which are of a length equal to the width of a typical aisleway or walkway plus the sum of the overall dimension of plurality of shelf assemblies 12 when the assemblies 12 are located directly adjacent one another. With this arrangement, the individual shelf assemblies 12 may be moved along the tracks to provide the desired access to the shelf units 14 thereof and when no access is needed to a particular assembly or shelf unit 14, the assemblies may be moved into close proximate relation with one another to obviate the need for access aisleways or walkways thereto. It will be appreciated, of course, that various other applications and installations may be made of the shelf assemblies 12 without departing from the scope of fair meaning of the present invention.

Referring now in detail to the construction of one of the shelf units 14 incorporated in the shelf assemblies 12 of the system 10, the particular details of which are representative of all of the shelf units 14, each of the units 14 comprises a generally rectangular-shaped, horizontally disposed shelf member, generally designated by the numeral 22 which includes a top or upper surface 24, a bottom or lower surface 26, a front edge 28, back or rearward edge 30 and opposed ends 32, 34. The shelf members 22 are preferably fabricated of a relatively inexpensive strong rigid material, such as a composition hardboard, although said members may be fabricated of alternative meterials, such as particle board, or multiple laminations of cardboard or fiberboard such as multiple layers of corrugated cardboard of the type well known in the art. In the embodiment illustrated in the drawings, the dimensions of the shelf member are approximately 36 inches long by 12 inches deep, with the hardboard thickness being approximately $\frac{1}{8}$ inch.

Each of the shelf units 14, together with one of the shelf members 22, comprises a liner member which is preferably fabricated of corrugated paperboard or cardboard and is intended to enclose the ends and rearward side of each of the shelf units 14, as illustrated. Each liner member 36 comprises a back section 38 and opposed end sections 40, 42 which are integrally connected to the opposite ends of the back section 38 by means of integral folded corners 46, 48. As will be appreciated, the length of the back section 38 of each of the liner members 36 is approximately equal to the length of the associated shelf member 22, while the length of the end sections 40, 42 of each of the liner members 36 is approximately equal to the depth of the associated shelf members 22. For purposes to be hereinafter described, the upper and lower edges of each of the end sections 40, 42 of each liner member 36 are formed with an integral outwardly folded flange portion 48 and 50, and the lower edge of the back section 38 of each liner member 36 is formed with a pluality of three laterally spaced, integral downwardly extending tabs 52 which cooperate with laterally aligned slots 54 formed in the rearmost portion of the associated shelf member 22. The function of the flanges 48, 50, tabs 52 and slots 54 will become apparent in connection with the description of overall assembly of each of the shelf units 14.

Associated with each of the shelf members 22 and liner members 36 is a plurality of four generally vertically disposed post members, generally designated by the numeral 56. The post members 56 are preferably generally rectangular in cross section and are of a length (height) which corresponds to the vertical spacing between the plurality of shelf members 22 of each of the shelf assemblies; specifically the length of the posts 56 is equal to the vertical spacing between the flange portions 48, 50 of the end section 40, 42 of the liner members 36. In a preferred construction of the present invention, the post members 56 are fabricated of a suitable composition or particle board, although various other materials would be satisfactory, such as wood, etc. The upper and lower ends of each of the post members 56 is provided with a pair of blind bores or recesses 58 which are adapted to telescopically receive the ends of alignment means in the form of alignment pins 60 which function in a manner hereinafter to be described in the assembly of the shelf units 14. The alignment pins 60 may be of any suitable size and length to assure for proper vertical alignment and/or orientation of the posts 56, and in the preferred embodient described herein, the pins are preferably of $\frac{1}{8}$ inch diameter steel stock and are approximately 2 inches long, with the depth of the blind bores 58 being approximately 1 inch.

Figure 5:
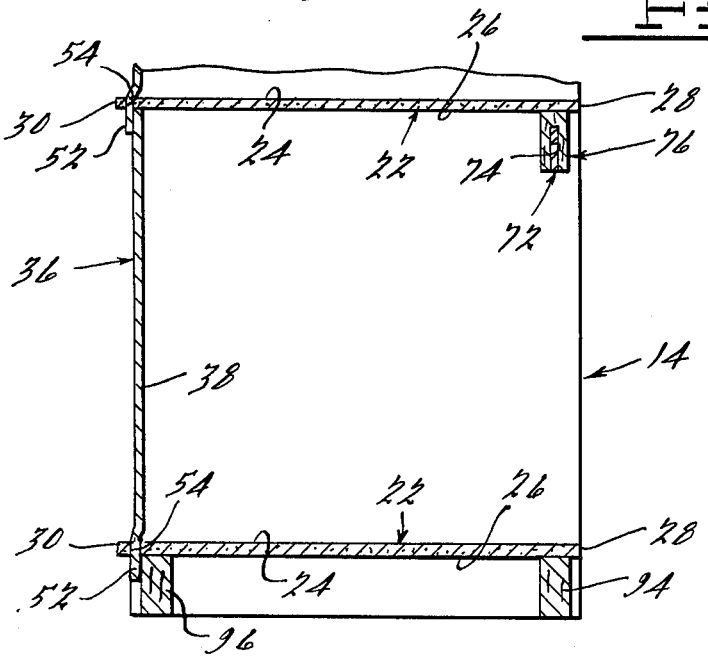
FIG. 5 is a cross-sectional view through the shelf unit and associated base structure shown in FIG. 3.
Figure 6:
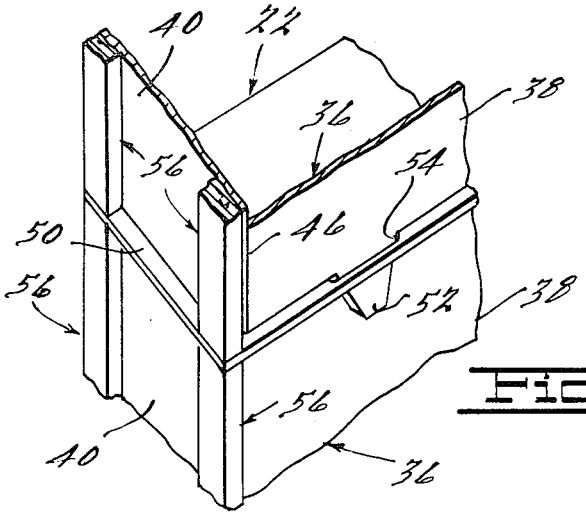
FIG. 6 is an elevated perspective view, partially broken away, of the rearward side of two of the shelf units of the present invention.

Together with the posts 56, the alignment pins 60 are adapted to cooperate with and extend through pairs of apertures 62 formed in the forward and rearward portions of the flanges 48 and 50 of the liner member 36 of each shelf unit 14, as well as with pairs of aligned openings 64 formed in each of the corners of the shelf member 22 of each shelf unit 14. The laterally inner sides of the forwardmost pair of post members 56 of each shelf unit 14 are formed with a pair of slats 68 which are adapted to align with openings 68 in the end sections 40, 42 so as to receive the opposite ends 70 of a laterally extending reinforcing bar 72. The bar 72 is preferably fabricated of metal and is adapted to be received within an elongated groove 74 of a horizontal support member 76 that is preferably fabricated of composition or particle board and, along with the bar 72, extends between the end sections 40, 42 adjacent the upper and forwardmost portion of the shelf unit 14. The reinforcing bar 72 and horizontal support member 76 are intended to function in rigidifying the structure of shelf unit 14 and function as a support means for the next upwardly adjacent shelf member 22, the lower side 26 of which is intended to bear directly upon the upper side of the support member 76, as best seen in FIG. 5. It is to be noted that the associated reinforcing bars 22 and support members 76 cooperate in a synergistic manner in assuring against rotation or deflection of the bars 72 and providing for high capacity beam loading.

Figure 7:
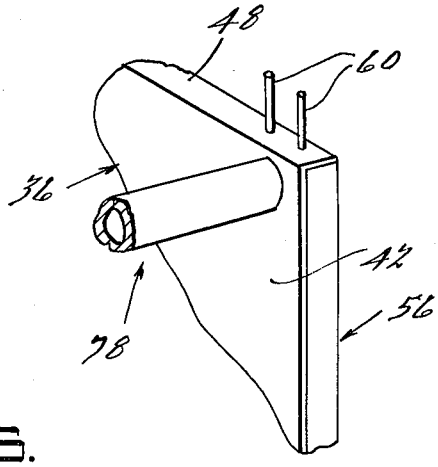
FIG. 7 is an elevated perspective view similar to FIG. 4 and illustrates a slightly modified embodiment of the present invention.

FIG. 7 illustrates a slightly modified embodiment wheren the shelf unit, instead of being provided with the support member 76 and associated reinforcing bar 72, is provided with a generally tubular-shaped reinforcing member 78, the longitudinally opposite ends of which are adapted to be telescopically received within suitable openings 80 in the end sections 40, 42 of the liner member 36 and cooperative aligned openings in the associated posts 56, whereby the tube member 78 may serve the same function as the reinforcing bar 72 and support member 76 which are embodied in the preferred construction of the present invention.

The base structure 16 may be of any suitable construction and is herein illustrated by way of example, as comprising a pair of spaced parallel end members 90, 92 which are interconnected with a pair of cross members 94, 96 to form a parallelpiped or rectangular-shaped structure that is of the same general shape and dimension as the shelf members 22 and, as best illustrated in FIG. 3, is adapted to underlie the lowermost of the shelf members 22 and be secured thereto by means of a plurality of four sets of pairs of upwardly extending alignment pins 60 in a manner hereinafter to be described. As previously mentioned, in the event the shelf assemblies 12 are operatively mounted upon a structure providing for rolling or sliding movement thereof, suitable rollers or the like (not shown) may be operatively mounted upon the base structure 16 so as to cooperate, for example, with a track system such as the tracks 18 and 20 shown in FIG. 1.

Referring now to the method of assembly of the shelf assemblies 12 of the present invention, assembly of the shelf assemblies 12 is accomplished by initially assembling the cross members 94, 96 with the end members 90, 92 of the base structure 16. This may be achieved by providing suitable grooves or mortise slots within the end members 90, 92 for nestingly receiving the opposite ends of the cross members 94, 96, as best seen in FIG. 3. Thereafter, a plurality of four pairs of alignment pins 60 are inserted within a corresponding number of blind bores 58 in the end members 90, 92, with the result that the alignment pins 60 will project upwardly from the upper side of the base structure 16, as seen in FIG. 3. Thereafter, the lowermost shelf member 22 is positioned directly above the base structure 16 and is lowered downwardly thereonto in a manner such that the upper ends of the alignment pins 60 project upwardly into and through openings 64, located in the four corners of the shelf member 22. The shelf member 22 is pressed downwardly upon the pins 60 so that the underside or bottom surface 26 thereof is continuously engaged and rests upon the upper side of the assembled base structure 16. Thereafter, the liner member 36 of the lowermost shelf unit 14 is positioned directly above the lowermost shelf member 22 such that the flange portions 50 on the end sections 40, 42 thereof are positioned directly above the alignment pins 60 projecting upwardly from the upper side of the shelf member 22. The liner member 36 is thereafter pressed downwardly such that the upper ends of the alignment pins 60 will pass into and through the openings 62 in the flange portions 50, and at the same time, tabs 52 on the lower edge of the back section 38 of the liner member 36 will move downwardly into and through the slots 54 formed along the rearward edge of of the shelf member 22, as best seen in FIG. 5. After the liner member 36 has been thus positioned upon the shelf member 22, the plurality of four post members 56 are arranged adjacent the four corners of the partially assembled shelf unit 14, with the two posts 56 provided with the slots 66 being located adjacent the front side of the unit 14. The posts 56 are aligned with the respective alignment pins 60 and are pressed downwardly such that the upper ends of the pins 60 are telescopically received within the blind bores 58 formed in the lower ends of the posts 56. After the four post members 56 have been assembled onto the alignment pins 60, the upper flange portions 48 on the end sections 40, 42 of the liner member 36 are folded laterally outwardly such that the openings 62 therein are aligned with the blind bores 58 in the upper ends of the post members 56, after which time a plurality of four pairs of alignment pins 60 are inserted through the openings 62 in the flange portions 48 and into the blind bores 58 in the upper ends of the post members 56. Once the four post members 56 have been properly assembled, as above described, the reinforcing bar 72 is assembled by inserting the longitudinally opposite ends 70 thereof through the openings 68 in the liner member end sections 40, 42 and into the slots 66 in the forwardmost two post members 56. Thereafter, the horizontal support member 76 may be surmounted upon the reinforcing bar 72, whereby the bar 72 is received into the recess 74 in the underside of the support member 76 in the manner best shown in FIG. 5.

The aforedescribed procedure results in complete assembly of one of the shelf units 14 (the lowermost unit 14) and the procedure is repeated in order to complete an entire vertical stack of units 14, resulting complete construction of each of the assemblies 12 embodied in the storage system 10 of the present invention. In other words, the next upwardly adjacent shelf unit 14 is assemblied onto the unit 14 theretofore assembled by initially assembling the next upwardly adjacent shelf member 22 upon the upwardly projecting alignment pins 60 and the remainder of the shelf members 22, liner members 36, post members 56, etc., are successively assembled on top of one another to provide the complete assembly 12 shown, for example, in FIG. 2. The upper end of the assembly is completed by placing the uppermost shelf member 22 on top of the upwardly projecting alignment pins 60 in the uppermost set of post members 56, and in view of the fact that the upper or top shelf member 22 would typically not be carrying any load, a reinforcing bar 72 and horizontal support member 76 are not typically required on the upper shelf, although they may be provided if desired. Once the top shelf member 22 is in place, a pair of end members 102 may be surmounted upon the upwardly extending alignment pins 60, with the end members 102 being of the same general construction as the end members 92 of the base structure 16, except that they would not be provided with the mortised grooves required for receiving the opposite ends of the cross members 94 of the structure 16. Preferably, although not necessarily, a plurality of individual tab elements 100, as shown in FIG. 3, are inserted downwardly through the slots 54 in the top shelf member 22 and are arranged directly behind the upper edge of the next lower adjacent liner member 36 and function in the same manner as the plurality of tabs 52 on the lower edge of each of the back sections 38 of the liner members 36 in properly positioning the upper edge of the lower adjacent back section 38 and permitting the same from being inadvertently pushed backwardly out of underlying relation with the next upwardly adjacent shelf member 22. This procedure finally completes the assembly 12 which may be thereafter placed into service either by providing rollers so that the same may be utilized individually or in back-to-back relation upon a rolling track system incorporating, for example, the tracks 18, 20, or alternatively, the assembled plurality of shelf units 14 constituting the shelf assembly 12 may be placed upon any suitable support surface, such as the floor or the like preparatory to use thereof.

It will be seen from the foregoing that the present invention provides a novel storage system consisting of one or more shelf assemblies, each of which comprises a plurality of vertically stacked shelf units. By virtue of the fact that particleboard and corrugated cardboard are utilized in the structural members, the storage system will be seen to be extremely inexpensive, to have low shipping and packaging costs, resistant to damage in shipment and handling and yet will provide a strong and durable storage facility. By forming the liner member into a generally U-shaped shell, a one-piece enclosure arrangement is provided which imparts substantial rigidity to the system, which rigidity is enhanced by means of the locking tab arrangement and the interconnection between the vertical posts provided by the alignment pins 60. By virtue of the fact that such pins project through the shelf members as well as the flange portions 48, 50 of the U-shaped liner member, the shelf construction is "tied" together in a manner so as to provide for high structural integrity so as to have a long and effective operational life. The use of two alignment pins in each of the upper and lower ends of the post members prevents rotation of the post members and allows the transfer of load as would be accomplished through the use of a single post running the entire height of a conventional storage device. The pins further implement the integration of the post-shell (liner) assembly to the shelf members, with the pin arrangement providing for convenience of assembly not found in similar shelving arrangements of the prior art. As will be appreciated by those skilled in the art, the size and number of shelf units incorporated in a single assembly may be varied significantly so as to provide for different storage facilities consistent with desired applications.

While it will be apparent that the preferred embodiments of the invention disclosed are well calculated to fulfill the objects above stated, it will be appreciated that the invention is susceptible to modification, variation and change without departing from the proper scope or fair meaning of the subjoined claims.

I claim:

1. A shelf-type storage system comprising, a plurality of vertically stackable individual shelf units, each of said units including a generally rectangular-shaped, horizontally arranged shelf member, a one-piece vertical liner member comprising spaced parallel end sections and a back section extending between and connected integrally to said end sections, said liner member closing the ends and back of said shelf unit and providing a front opening to said unit though which objects may be placed upon and removed from said shelf member, a plurality of four vertically extending post members disposed one on each corner of said shelf unit, and alignment means extending generally vertically from selected ends of said post members and coacting with said liner member and said shelf member for securing said shelf member, liner member and post members in a unitized assembly adapted for vertical stacking on like units.

2. The invention as set forth in claim 1 which includes a support member extending horizontally between the ends of the two post members adjacent said front opening of said unit for supporting the next upwardly adjacent shelf member.

3. The invention as set forth in claim 2 wherein said support member includes reinforcing means.

4. The invention as set forth in claim 3 wherein said reinforcing means includes a relatively rigid metallic bar at least in part recessed within said support member and having outwardly extending end portions adapted to be nestingly received within openings in the upper ends of said two post members.

5. The invention as set forth in claim 1 wheren said liner member is fabricated of a relatively rigid, but foldable cardboard or paperboard-like material.

6. The invention as set forth in claim 5 wherein the upper and lower edge portions of said end sections of said liner member include generally horizontally disposed, outwardly projecting flange portions.

7. The invention as set forth in claim 6 wherein said alignment means comprises means extending from the ends of said posts and adapted to project through suitable openings in said flange portions and said shelf member.

8. The invention as set forth in claim 1 which includes locking and positioning means for securing the lower edge of said back section of said liner member to said shelf member.

9. The invention as set forth in claim 8 wherein said locking and positioning means comprises downwardly projecting tab elements on said back section of said liner member adapted to be received within complementary-shaped openings along the rearward edge of said shelf member.

10. The invention as set forth in claim 1 which includes a base structure for supporting a plurality of vertically stackable shelf units upon a suitable support surface or the like.

11. The invention as set forth in claim 1 wheren said alignment means comprises vertically extending pin elements projecting from the upper and lower ends of said plurality of four post members.

12. A shelf-type storage system comprising a base structure and at least two shelf units stacked vertically upon said base structure, said shelf units each including a generally rectangular-shaped, horizontally arranged shelf member disposed in vertical spaced relation to said base structure, said shelf units also each including a liner member comprising spaced parallel end sections and an integral back section, said liner members extending vertically upwardly from the upper sides of the associated of said shelf members adjacent the marginal end and back edges thereof so as to close the ends and back of each unit and provide a front opening through which objects may be placed upon and removed from the associated shelf members, a plurality of four post members arranged one adjacent each of the four corners of each of said shelf members and extending vertically upwardly therefrom to a position underlying the next upwardly adjacent shelf member, and alignment means cooperable with portions of said liner members and said shelf members and associated with selected ends of said post members for securing and vertically aligning the same and for securing and positioning said shelf member and liner members relative to each other and to said post members.

13. The invention as set forth in claim 12 which includes a support member extending horizontally between the ends of the two post members adjacent said front openings of each of said units for supporting the next upwardly adjacent shelf member.

14. The invention as set forth in claim 13 wherein said support members include reinforcing means.

15. The invention as set forth in claim 14 wherein each of said reinforcing means includes a relatively rigid metallic bar at least in part recessed within the associated of said support members and which has outwardly extending end portions adapted to be received within openings in the upper ends of the associated of said two post members.

16. The invention as set forth in claim 12 wherein said liner members are fabricated of a relatively rigid, but foldable cardboard or paperboard-like material.

17. The invention as set forth in claim 16 wherein the upper and lower edge portions of said end sections of said liner membes include generally horizontally disposed, outwardly projecting flange portions.

18. The invention as set forth in claim 17 wherein said alignment means comprises means extending from the ends of said posts and adapted to project through suitable openings in said flange portions and said shelf members.

19. The invention as set forth in claim 12 which includes locking and positioning means for securing the lower edges of said back section of said liner members to the lower adjacent shelf member.

20. The invention as set forth in claim 19 wherein said locking and positioning means comprises downwardly projecting tab elements on said back section of said liner members adapted to be received within complementary-shaped openings along the rearward edge of the lower adjacent shelf member.

21. The invention as set forth in claim 12 which includes alignment means for aligning said shelf units on said base structure.

22. The invention as set forth in claim 12 wherein said alignment means comprises vertically extending pin elements projecting from the upper and lower ends of said plurality of post members.

23. The invention as set forth in claim 12 wherein said base structure ocmprises laterally spaced apart end sections and front and rear sections which underlie the marginal edge portions of the lowermost of said shelf members.

24. The invention as set forth in claim 23 which includes a plurality of alignment pins extending upwardly from said base structure and cooperating with the lowermost shelf member and liner member and with lower ends of the lowermost of the said post members for securing the lowermost shelf unit upon said base structure.

* * * * *

UNITED STATES PATENT AND TRADEMARK OFFICE

CERTIFICATE OF CORRECTION

PATENT NO. : 4,418,627

DATED : December 6, 1983

INVENTOR(S) : Edward A. Baker

It is certified that error appears in the above-identified patent and that said Letters Patent is hereby corrected as shown below:

| | | | |
|---|---|---|---|
| Column 3, | line 7, | "ganerally" should be -- generally --. |
| Column 3, | line 33, | "of" (first occurrence) should be — or —. |
| Column 4, | line 35, | "embodient" should be -- embodiment --. |
| Column 4, | line 68, | "wheren" should be — wherein —. |
| Column 5, | line 20, | "of" (second occurrence) should be --or--. |
| Column 5, | line 63, | delete "of" (second occurrence). |
| Column 7, | line 59, | "though" should be -- through --. |
| Column 8, | line 14, | "wheren" should be — wherein —. |
| Column 8, | line 40, | "wheren" should be -- wherein --. |
| Column 9, | line 24, | "membes" should be -- members --. |
| Column 10, | line 19, | "ocmprises" should be -- comprises --. |

Signed and Sealed this

*Twenty-sixth* Day of *June 1984*

[SEAL]

*Attest:*

GERALD J. MOSSINGHOFF

*Attesting Officer*

*Commissioner of Patents and Trademarks*